US006748719B2

(12) United States Patent
Salicini et al.

(10) Patent No.: US 6,748,719 B2
(45) Date of Patent: Jun. 15, 2004

(54) PRODUCT WRAPPING MACHINE

(75) Inventors: Sandro Salicini, Monterenzio (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/419,697

(22) Filed: Apr. 21, 2003

(65) Prior Publication Data

US 2003/0230048 A1 Dec. 18, 2003

(30) Foreign Application Priority Data

Apr. 23, 2002 (IT) ..... BO2002A0220

(51) Int. Cl.[7] ..... B65B 11/30; B65B 11/58
(52) U.S. Cl. ..... 53/171; 53/234
(58) Field of Search ..... 53/171, 176, 225, 53/227, 234, 542

(56) References Cited

U.S. PATENT DOCUMENTS 4,265,073 A * 5/1981 Seragnoli ..... 53/542
4,352,265 A * 10/1982 Hansel et al. ..... 53/234
4,597,246 A * 7/1986 Mattei et al. ..... 53/542
4,711,065 A * 12/1987 Focke et al. ..... 53/171

FOREIGN PATENT DOCUMENTS

DE 3201222 * 7/1983 ..... 53/234

* cited by examiner

*Primary Examiner*—John Sipos
(74) *Attorney, Agent, or Firm*—Ladas & Parry

(57) ABSTRACT

A machine for wrapping products, wherein a stacking plate receives a succession of wrapped products, and groups the products into a succession of stacks, which are transferred, axially with respect to the stacking plate, to an input station of a wrapping wheel for wrapping the stacks in respective sheets of wrapping material, and transferring the wrapped stacks to a substantially horizontal output conveyor; the wrapping wheel rotating in steps about a horizontal first axis, and having a number of radial seats; and the stacking plate being mounted to rotate about a second axis perpendicular to the first axis and defining, with the first axis, a plane through the input station and forming a substantially 30° angle with a vertical plane through the first axis.

10 Claims, 2 Drawing Sheets

PRODUCT WRAPPING MACHINE

The present invention relates to a product wrapping machine.

More specifically, the present invention relates to a product wrapping machine of the type comprising an ordering plate for receiving and arranging a random stream of products into an orderly succession; a first wrapping unit for successively receiving the products from the ordering plate and wrapping them in respective first sheets of wrapping material; a stacking plate for successively receiving the wrapped products and grouping them into a succession of stacks; a second wrapping unit for successively receiving the stacks from the stacking plate and wrapping them in respective second sheets of wrapping material; and substantially horizontal output conveying means for receiving the wrapped stacks; the second wrapping unit comprising a wrapping wheel rotating in steps about a horizontal axis and having a number of radial seats, each for receiving a relative second sheet of wrapping material and a relative stack from the stacking plate at an input station, and for releasing the relative wrapped stack to the output conveying means at an output station.

The present invention is particularly advantageous for use on machines for wrapping sweets and similar, to which the following description refers purely by way of example.

BACKGROUND OF THE INVENTION

In known machines, and particularly sweet wrapping machines, of the type described above, the stacking plate is normally mounted on a drive box to rotate about a vertical axis, and has an output station located directly beneath the periphery of the wrapping wheel, and an input station for receiving the wrapped sweets from the first wrapping unit, which is located to the side of the drive box and receives the first sheets of wrapping material successively from a relative feed line.

Known machines of the above type have several drawbacks, mainly on account of the location, as described above, of the stacking plate and relative drive box.

That is, since the output conveying means must be positioned substantially horizontally, and the horizontal position of the stacking plate necessarily calls for a wrapping wheel input at the lowest point on the wrapping wheel, i.e. at 90° to an output communicating with the output conveying means, the wrapping wheel must have at least four radial seats spaced 90° apart. But since complete folding and closing of each second sheet of wrapping material about the relative stack require at least three folding and/or sealing stations, the above positions of the stacking plate and wrapping wheel, and the horizontal position of the output conveying means call for a wrapping wheel with at least eight radial seats spaced 45° apart, i.e. a wrapping wheel of relatively high cost and poor efficiency, on which, for each complete turn of the wrapping wheel, each seat makes eight stops, only five of which at most are made use of.

Moreover, given the horizontal position of the stacking plate, the supporting and drive box is located directly alongside the first wrapping unit, with the bottom of the box practically on a level with the input station at which the first sheets of wrapping material are fed to the first wrapping unit. Such an arrangement prevents the end portion of the feed line supplying the first sheets of wrapping material from being routed underneath the supporting and drive box, so that the only alternative, which is both bulky and unpractical, is to position the end portion substantially parallel to the wrapping wheel axis.

Finally, the supporting and drive box is known to be fitted with an external handwheel for operating the machine manually. Given the horizontal position of the stacking plate and the vertical position of the supporting and drive box, however, the handwheel is normally relatively low down and awkward to operate.

SUMMARY OF THE INVENTION

It is an object of the present invention to provide a machine for wrapping products, in particular sweets, designed to eliminate the aforementioned drawbacks.

According to the present invention, there is provided a machine for wrapping products, as claimed in claim 1 and preferably in any one of the claims depending directly and/or indirectly on claim 1.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
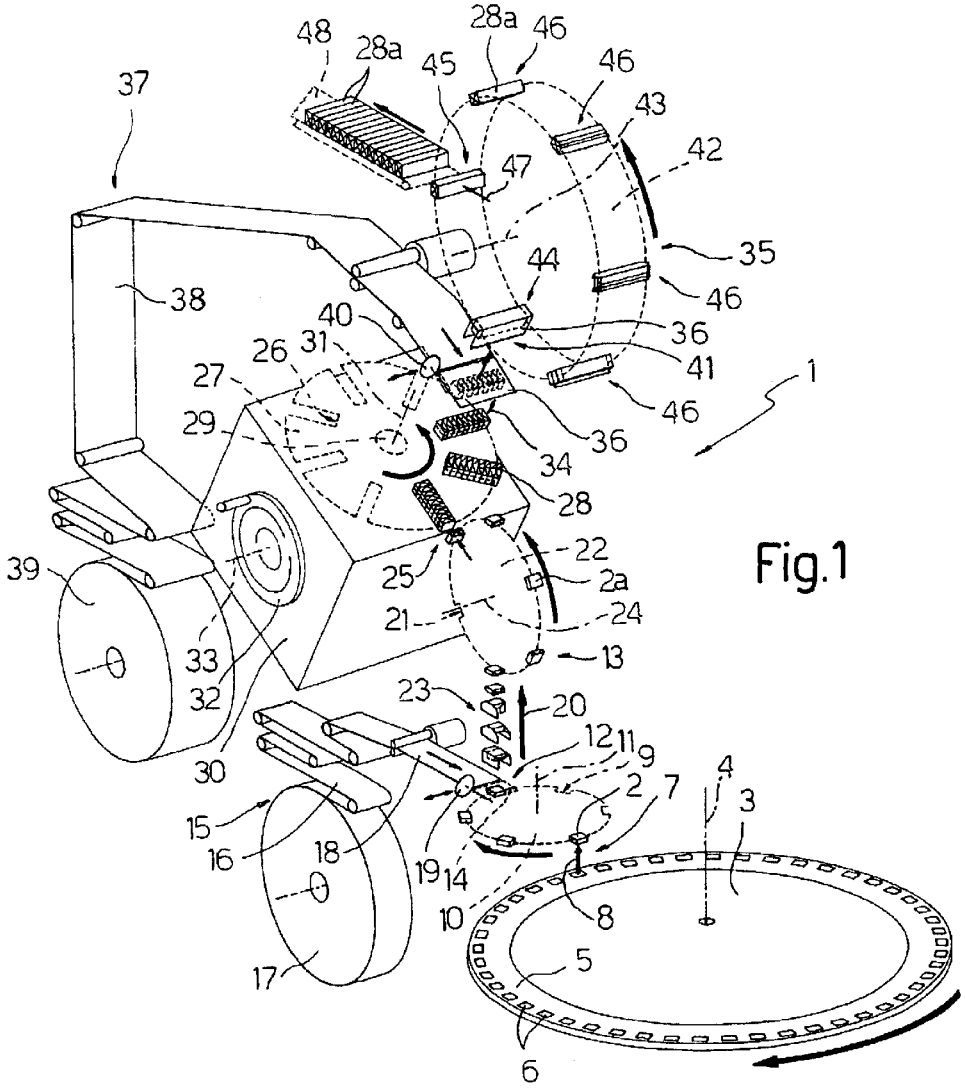
FIG. 1 shows a schematic view in perspective, with parts removed for clarity, of a preferred embodiment of the machine according to the present invention.
Figure 2:
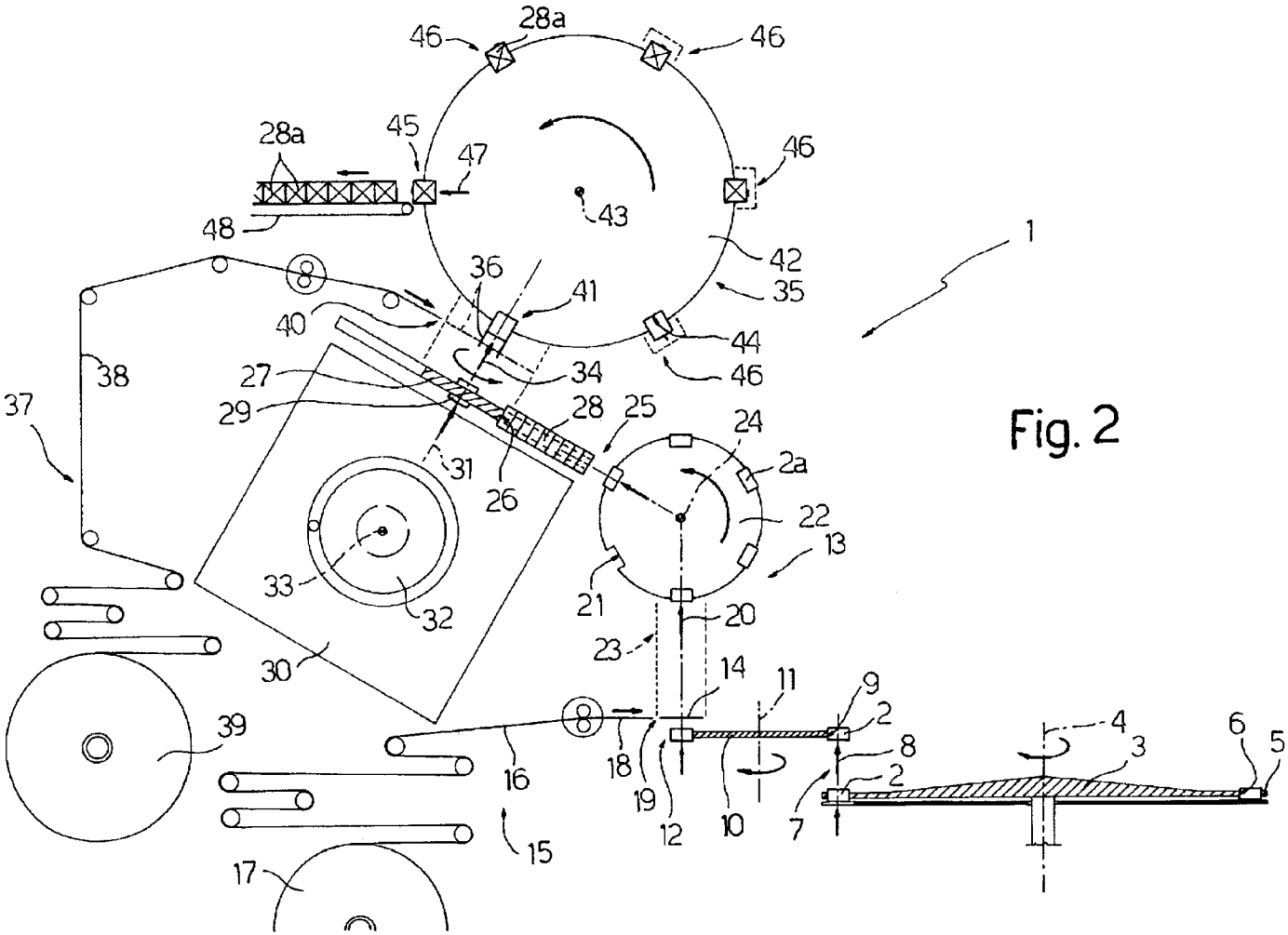
FIG. 2 shows a schematic front view of the FIG. 1 machine.

Number 1 in the accompanying drawings indicates as a whole a machine for wrapping sweets 2, and which comprises a known ordering plate 3 rotating (clockwise in the drawings) in steps about a vertical axis 4 to receive a random stream (not shown) of sweets 2, and to arrange sweets 2 in an orderly succession along an ordering ring 5, which defines the outer periphery of ordering plate 3, and comprises a number of through seats 6 for receiving respective sweets 2. Ordering ring 5 extends through a transfer station 7, where sweets 2 are expelled upwards from relative seats 6 by a known push assembly (not shown), and are fed, in a direction 8 parallel to axis 4, into respective peripheral seats 9 on a transfer wheel 10 located alongside ordering plate 3 and rotating in steps about an axis 11, parallel to axis 4, to feed sweets 2 successively from transfer station 7 to a transfer station 12 diametrically opposite transfer station 7.

Transfer wheel 10, which is known, defines an input wheel of a wrapping unit 13 for receiving sweets 2 successively from ordering plate 3, and for wrapping them in respective sheets 14 of wrapping material fed to transfer station 12 by a feed line 15, wherein a continuous web 16 is unwound off a reel 17 and fed along a path comprising a substantially horizontal end portion 18 terminating at transfer station 12 and extending through a cutting station 19, where sheets 14 of wrapping material are cut off web 16.

End portion 18 extends in a direction substantially coplanar with the plane defined by axes 4 and 11, and at a level just above the level of seats 9, so that each sheet 14 of wrapping material is fed over a respective sweet 2 at transfer station 12 to define, with respective sweet 2, a whole which is transferred from transfer wheel 10, in a direction 20 parallel to transfer direction 8, and by means of a known push assembly (not shown), to a respective peripheral seat 21 of a further transfer wheel 22 via a known wrapping assembly 23, on which each sweet 2 is wrapped completely, in known manner, inside relative sheet 14 of wrapping material.

Transfer wheel 22, which is known, defines an output wheel of wrapping unit 13, is located directly over transfer wheel 10, rotates in steps, anticlockwise in the drawings, about a substantially horizontal axis 24, and successively feeds wrapped sweets 2, indicated 2*a*, to a transfer station 25, where a known push assembly (not shown) expels sweets 2*a* from relative seats 21, and feeds them successively into radial seats 26 of a known stacking plate 27, which successively receives and groups sweets 2*a* into a succession of stacks 28, each comprising a given number of sweets 2*a* and housed inside a respective radial seat 26.

Stacking plate 27 lies in a radial plane with respect to transfer wheel 22, is located on the opposite side of transfer wheel 22 to ordering plate 3 and over end portion 18 of feed line 15, and is fitted to an output shaft 29 of a drive box 30 for rotating shaft 29 in steps, anticlockwise in the drawings, about an inclined shaft 31 forming, over axis 24, a substantially 30° angle with respect to a vertical plane through axis 24. Drive box 30 supports stacking plate 27, is substantially in the form of a rectangular prism, and is also inclined substantially 30° with respect to direction 20, so as to be positioned alongside wrapping assembly 23, with its bottom end over the input end of end portion 18, so that end portion 18 is fully exposed and easily accessible for maintenance and changing web 16.

A handwheel 32 is fitted, in known manner, to the centre of a lateral surface of drive box 30, and rotates about an axis 33 perpendicular to axis 31 to permit manual operation of machine 1.

It should be pointed out that, given the tilt of drive box 30, with seats 26 positioned radially with respect to transfer wheel 22 at transfer station 25, handwheel 32 is located higher off the floor as compared with known solutions, and therefore much easier to use.

Stacking plate 27 transfers stacks 28 in steps about axis 31 to a position, spaced 90° apart from transfer station 25, where each stack 28 is expelled from relative seat 26 in a direction 34 parallel to axis 31, and fed to a wrapping unit 35 for receiving stacks 28 successively from stacking plate 27, and wrapping them in respective sheets 36 of wrapping material supplied by a feed line 37, wherein a continuous web 38 is unwound off a reel 39 and fed over seats 26 via a cutting station 40, where sheets 36 of wrapping material are cut off web 38. On wrapping unit 35, each sheet 36 forms, with relative stack 28, a whole which is transferred from stacking plate 27, in direction 34 and by means of a known push assembly (not shown), to an input station 41 of a wrapping wheel 42 forming part of wrapping unit 35 and mounted to rotate, anticlockwise in the drawings, in steps about a horizontal axis 43. Wrapping wheel 42 has a number of peripheral seats 44, each for receiving a relative stack 28 and a relative sheet 36 of wrapping material, and for feeding them along a circular path to an output station 45 via a succession of work station 46, where each sheet 36 of wrapping material is folded gradually about relative stack 28 to form a wrapped stack 28*a*.

At output station 45, a known expulsion device (not shown) expels stacks 28 from relative seats 26 in a substantially horizontal radial direction 47, and feeds them successively onto a horizontal output conveyor 48 positioned radially with respect to wrapping wheel 42.

Wrapping wheel 42 is located over ordering plate 3, and its axis 43 is perpendicular to axis 31, and defines, with axis 31, an inclined plane through input station 41 and forming a substantially 30° angle with a vertical plane through axis 43, and a 60° angle with a substantially horizontal plane through axis 43 and output station 45 and over input station 41.

The above arrangement enables the use of a wrapping wheel 42 with six seats 44 spaced 60° apart about axis 43, and which are more than sufficient to form a perfectly closed wrapping about each stack 28.

What is claimed is:

1. A machine for wrapping products (2), the machine comprising an ordering plate (3) for receiving a random stream of products (2) and arranging the products (2) into an orderly succession; a first wrapping unit (13) for successively receiving the products (2) from the ordering plate (3) and wrapping them in respective first sheets (14) of wrapping material; a stacking plate (27) for successively receiving the wrapped products (2*a*) and grouping them into a succession of stacks (28); a second wrapping unit (35) for successively receiving said stacks (28) from the stacking plate (27) and wrapping them in respective second sheets (36) of wrapping material; and substantially horizontal output conveying means (48) for receiving said wrapped stacks (28*a*); said second wrapping unit (35) comprising a wrapping wheel (42) rotating in steps about a horizontal first axis (43), and having a number of radial seats (44), each for receiving a relative said second sheet (36) of wrapping material and a relative said stack (28) from said stacking plate (27) at an input station (41), and for releasing the relative wrapped stack (28*a*) to said output conveying means (48) at an output station (45); and the machine being characterized in that said stacking plate (27) is mounted to rotate about a second axis (31) perpendicular to said first axis (43), and defining, with said first axis (43), an inclined plane forming a substantially 30° angle with a vertical plane through said first axis (43).

2. A machine as claimed in claim 1, wherein said input station (41) lies in said inclined plane.

3. A machine as claimed in claim 1, wherein said output station (45) lies in a horizontal plane through said first axis (43).

4. A machine as claimed in claim 1, wherein said input station (41) and said output station (45) are located on the same side of said vertical plane, and are spaced substantially 60° apart about said first axis (43).

5. A machine as claimed in claim 1, wherein each said radial seat (44) forms a 60° angle with each adjacent radial seat (44).

6. A machine as claimed in claim 5, wherein said first wrapping unit (13) comprises a transfer wheel (22) for feeding said wrapped products (2*a*) to said stacking plate (27); said transfer wheel (22) rotating about a third axis (24) parallel to said first axis (43); and said stacking plate (27) being positioned radially with respect to said transfer wheel (22).

7. A machine as claimed in claim 1, and comprising a drive box (30) for driving said stacking plate (27); said drive box (30) being located beneath said stacking plate (27), and being inclined like said second axis (31).

8. A machine as claimed in claim 7, wherein said first wrapping unit (13) comprises a feed line (15) for supplying said first sheets (14) of wrapping material, and a wrapping assembly (23) for wrapping each said product (2) in the relative said first sheet (14) of wrapping material; said wrapping assembly (23) extending alongside said drive box (30); and said feed line (15) comprising an output portion (18) extending beneath said drive box (30).

9. A machine as claimed in claim 8, wherein said output portion (18) is substantially horizontal.

10. A machine as claimed in claim 7, wherein said drive box (30) supports a handwheel (32) for manually operating the machine (1).

* * * * *